US009800979B2

(12) United States Patent
Ghaffari et al.

(10) Patent No.: US 9,800,979 B2
(45) Date of Patent: Oct. 24, 2017

(54) TUNABLE RIBBON MICROPHONE

(71) Applicant: Mohsen Ghaffari, Los Angeles, CA (US)

(72) Inventors: Mohsen Ghaffari, Los Angeles, CA (US); Maryam Ghaffari, Tehran (IR)

( * ) Notice: Subject to any disclaimer, the term of this patent is extended or adjusted under 35 U.S.C. 154(b) by 0 days.

(21) Appl. No.: 14/916,468

(22) PCT Filed: Nov. 12, 2014

(86) PCT No.: PCT/US2014/065253

§ 371 (c)(1),
(2) Date: Mar. 3, 2016

(87) PCT Pub. No.: WO2015/077099

PCT Pub. Date: May 28, 2015

(65) Prior Publication Data

US 2016/0255439 A1 Sep. 1, 2016

Related U.S. Application Data

(60) Provisional application No. 61/907,265, filed on Nov. 21, 2013.

(51) Int. Cl.
*H04R 9/04* (2006.01)
*H04R 9/08* (2006.01)
(Continued)

(52) U.S. Cl.
CPC ..... *H04R 9/048* (2013.01); *H04R 9/025* (2013.01); *H04R 9/045* (2013.01); *H04R 9/08* (2013.01);
(Continued)

(58) Field of Classification Search
CPC . H04R 1/04; H04R 1/222; H04R 1/46; H04R 7/14–7/22; H04R 9/025; H04R 9/045; H04R 9/048; H04R 9/08
See application file for complete search history.

(56) References Cited

U.S. PATENT DOCUMENTS 1,885,001 A * 10/1932 Olson ..... G01S 1/72 381/176
2,012,797 A * 8/1935 Whitman ..... H04R 17/00 348/205
(Continued)

FOREIGN PATENT DOCUMENTS

GB 191122049 A * 0/1912 ..... H04R 21/021

*Primary Examiner* — Joshua Kaufman

(57) ABSTRACT

A tunable ribbon microphone having magnets positioned within a small gap in between pieces of opposite poles. A conductive ribbon placed in an air gap between the magnets by an adjustable ribbon holder structure. The adjustable ribbon holder structure includes two ribbon holders and a ribbon tension control. The ribbon holder can be fixed from one side by sliding on one side or sliding on both sides. The ribbon tension control adjusts the tension of the elastic ribbon. By turning the ribbon tension control, turning motion translate to linear motion and change the distance between the ribbon holders and alter the tension of the ribbon. Changing the ribbon tension also possible by different ribbon tension control mechanism by rolled or folded the ribbon in one side or both side of the microphone. The tunable ribbon microphone may have more than one ribbon, adjustable ribbon holder structure and ribbon tension control.

19 Claims, 7 Drawing Sheets

(51) Int. Cl.

| | |
|---|---|
| ***H04R 9/02*** | (2006.01) |
| *H04R 7/22* | (2006.01) |
| *H04R 7/18* | (2006.01) |
| *H04R 1/22* | (2006.01) |
| *H04R 7/14* | (2006.01) |

(52) U.S. Cl.
CPC ..... *H04R 1/222* (2013.01); *H04R 7/14* (2013.01); *H04R 7/18* (2013.01); *H04R 7/22* (2013.01)

(56) References Cited

U.S. PATENT DOCUMENTS 2,178,216 A * 10/1939 Anderson ..... H04R 1/38 381/176
2,183,209 A * 12/1939 Anderson ..... H04R 3/08 381/176
2,226,934 A * 12/1940 Kannenberg ..... H04R 9/08 381/176
2,317,069 A * 4/1943 La Mar ..... H04R 1/22 181/171
2,346,395 A * 4/1944 Rettinger ..... H04R 1/38 381/162
2,348,356 A * 5/1944 Olson ..... H04R 9/08 181/158
2,361,656 A * 10/1944 Rogers ..... H04R 9/08 381/115
2,673,251 A * 3/1954 Duncan ..... H04R 9/048 181/158
3,435,143 A * 3/1969 Fisher ..... H04R 9/08 381/111
3,619,517 A * 11/1971 Bleazey ..... H04R 1/222 381/176
4,317,966 A * 3/1982 Lister ..... H04R 9/048 381/399
4,395,592 A * 7/1983 Colangelo ..... H04R 9/048 181/151
4,550,228 A * 10/1985 Walker ..... H04R 7/18 381/186
2006/0078135 A1* 4/2006 Royer ..... H04R 9/048 381/176
2006/0078152 A1* 4/2006 Royer ..... H04R 9/048 381/399
2007/0274555 A1* 11/2007 Crowley ..... H04R 1/06 381/399
2009/0116670 A1* 5/2009 Akino ..... H04R 9/048 381/176
2009/0141914 A1* 6/2009 Akino ..... H04R 9/048 381/176
2011/0261980 A1* 10/2011 Akino ..... H04R 9/048 381/176
2012/0269366 A1* 10/2012 Akino ..... H04R 9/048 381/173

* cited by examiner

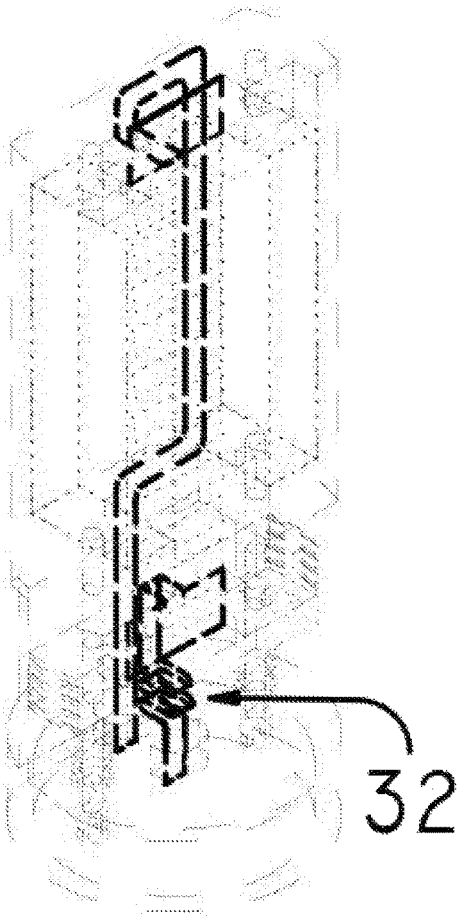
FIG. 4B
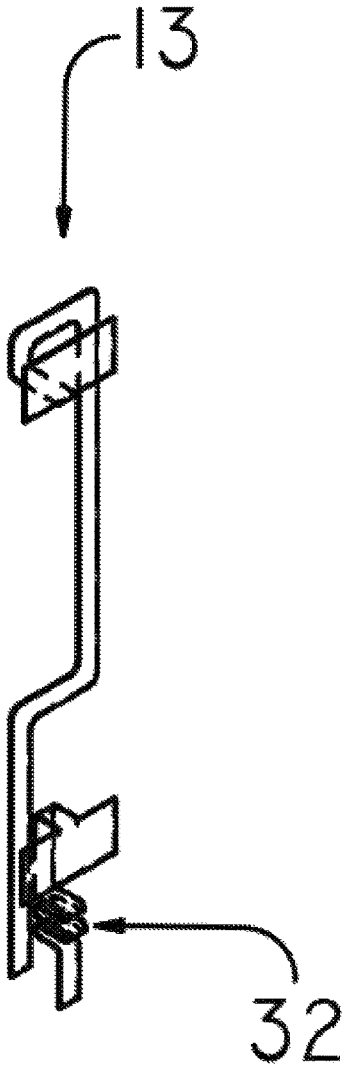
FIG. 4A
FIG. 4

Alternative tunable ribbon microphone design

TUNABLE RIBBON MICROPHONE

RELATED APPLICATIONS

This application is a 35 U.S.C §371 National Stage of International Patent Application No. PCT/US14/65253, field Nov. 12, 2014 which claims benefit of U.S. Provisional Patent Application No. 61/907,265, field Nov. 21, 2013.

FIELD OF THE INVENTION

The present invention relates to ribbon microphone and, more particularly, to tunable ribbon microphone.

BACKGROUND OF THE INVENTION

Ribbon microphones have a dominant footprint in recording history, and it has risen and fallen in different periods of time. In the 1950's the popularity of the ribbon microphones was at its peak.

The ribbon microphones are made with two separate magnets placed in parallel to the opposite poles with an air gap in between to generate a high magnetic field. A thin aluminum foil ribbon is placed in the middle of the magnetic field. The movement of the ribbon generates electrical signals. The signals are increased by a ratio of 1:20 or 1:25 with the use of a transformer.

Early ribbon microphones have very low current signal output due to the weak magnetic field produced by available magnets at that time. Many methods are employed to reach a stronger magnetic field such as increasing the size of the magnets, tapering the magnets or using ferromagnetic material to concentrate the magnetic field in the ribbon area. Because of this, the ribbon microphones were heavy and enormous. Another issue was the ribbon inside the ribbon microphones. The tension of the ribbon is a vital factor in the sound characteristic of the ribbon microphone. The ribbons are made of thin aluminum foil that is brittle, and by a blast of air quickly deform and lose tension. Consequently, the ribbon is put out of place and the microphone starts to generate distortion and loses its original frequency response.

With the rise in popularity of condenser and dynamic microphones with higher signal output, less noise, better frequency response, smaller size and lower weight, the ribbon microphone began to be replaced by condenser and dynamic microphones.

As the audio industry is transferring from analog to digital, engineers are discovering that ribbon microphone sounds more natural in comparison to condenser and dynamic microphones. The warmth and natural sound of the ribbon microphone's especially smooth high frequencies were reasons to raise new demands for ribbon microphones. On the other hand, material science has developed through the years since the early ribbon microphones were invented. A new generation of ribbon microphones has begun to attract the microphone market.

As the demand for ribbon microphones rises many companies are starting to research and develop ribbon microphones with today's technology. The old magnets such as Alnico magnets are being replaced by neodymium magnets for a stronger magnetic field. New transformers and buffer amps are being designed to maximize the sensitivity and terminate the risk of damaging the ribbon by phantom power. Furthermore, new alternative ribbons, called film ribbon, are being introduced to the market. Referring to patent No.: U.S. Pat. No. 8,218,795 B2 the film ribbons are much stronger and have an inherent elasticity to keep their original shape and tension by use of polyethylene terephthalate film polymer and a new method of corrugating. The shape memory of the new ribbon helps the ribbon to return to the original shape any time, it is given tension by a blast of air, phantom power short circuiting or any other reason.

New ribbon microphones are growing fast due to the nature of their sound, practical size, acceptable output signal and sturdiness in comparison to the earlier versions. However, the biggest potential of modern day ribbon microphones has not yet been revealed. The greatest potential will be something that none of the other types of microphones are capable of: The ability to control the tension of the ribbon.

With the old ribbon materials, it was impossible to change the tension of the ribbon repeatedly. Instead, the new alternative materials can be used as an advantage to build a tunable ribbon microphone with a function to change the tension of the ribbon easily and quickly by one. Thus, one always has the choice to set the ribbon tension back to the factory default or explore new characteristics. In conventional microphones, the tension of the ribbon or diaphragm of microphones is always precisely adjusted in the manufacturing depending on the use of the microphone, and the user does not have any control over it. So in conventional microphones recording engineers always use many microphones with different characteristics that suits a particular type of sound, and they have to change many microphones to reach their desired result. The different tension of ribbon or diaphragm can produce different frequency and dynamic responses. The ability to change ribbon tension in tunable ribbon microphone helps recording engineers to have more options before deciding to change the microphone. Different tensions of the ribbon in addition to changing the frequency response and harmonics, also has a direct effect on initial attack and resonates in dynamic form of the captured sound. By controlling the tension of the ribbon one can achieve much broader possibilities to record a sound. By using tunable ribbon microphones the process to find the desired sound can be much faster, and the result would be more interesting. In contrast, using conventional microphones involves changing to find the best transducer for the purpose of recording which is time-consuming and in some cases finding the desired result is impossible without using a tunable ribbon microphone.

Tunable ribbon microphone brings a new world of experimenting for audio engineers to discover the effect of different tension of ribbon on different sound sources. The tunable ribbon microphone will potentially revolutionize the microphone industry and open up new angles of development for microphone designers and manufacturers.

It is therefore an object of invention to provide control over pressure of the ribbon by one.

It is another object of the invention to provide an improved structure for a ribbon microphone which is simple in construction, cost effective and more practical than the conventional ribbon microphones.

It is another object of the invention to provide a fast, easy and precise way to adjust the pressure of the ribbon on tunable ribbon microphone.

It is another object of the invention to provide a ribbon microphone that can be specifically and precisely adjusted for different situations and sound sources.

It is another object of the invention to provide a ribbon microphone that is a more practical tool for vocal recording due to many different characteristics of vocal sounds.

It is another object of the invention to provide an ability to tune ribbon pressure for a certain fundamental frequency matched by sound source to capture most of the harmonics.

It is yet another object of the invention to provide an ability to adjust the microphone to be capable of capturing ultra-high pressure sound sources.

It is yet another object of the invention to control the dynamic of signals before using any signal compressor by simply adjusting ribbon pressure.

It is yet another object of the invention to emphasis certain frequencies from sound sources and shape the captured sound before any conversion.

It is yet another object of the invention to be able to record a larger variety of sound with just one microphone.

SUMMARY OF THE INVENTION

In accordance with the present invention, there is provided a tunable ribbon microphone having magnets positioned adjacent with an air gap in between the pieces on opposite poles. An elastic ribbon is placed in the air gap by the adjustable ribbon holder structure. The adjustable ribbon holder structure includes two ribbon holders and a ribbon tension control. One of the ribbon holders can be fixed on one side and the other ribbon holder slides toward the center of the adjustable ribbon holder structure. The ribbon tension control changes the tension of the elastic ribbon. By adjusting the ribbon tension control, rotational motion translates into linear motion and changes the position of the ribbon holders. Accordingly, the change of the distance between the ribbon holders alters the tension of the ribbon. The amount of tension can be measured by the help of measurement bar imprinted on ribbon tension control.

BRIEF DESCRIPTION OF THE DRAWINGS

A complete understanding of the present invention may be obtained by reference to the accompanying drawings, when considered in conjunction with the subsequent, detailed description, in which:

FIG. 4 is an exploded view of a wiring system;

FIG. 4*a* is an exploded view of the components of a wiring system;

FIG. 4*b* is an exploded view of the components of a wiring system and their positions in regards to the magnetic field structure and the adjustable ribbon holder structure;

For purposes of clarity and brevity, like elements and components will bear the same designations and numbering throughout the Figures.

DESCRIPTION OF THE PREFERRED EMBODIMENT

Figure 1:
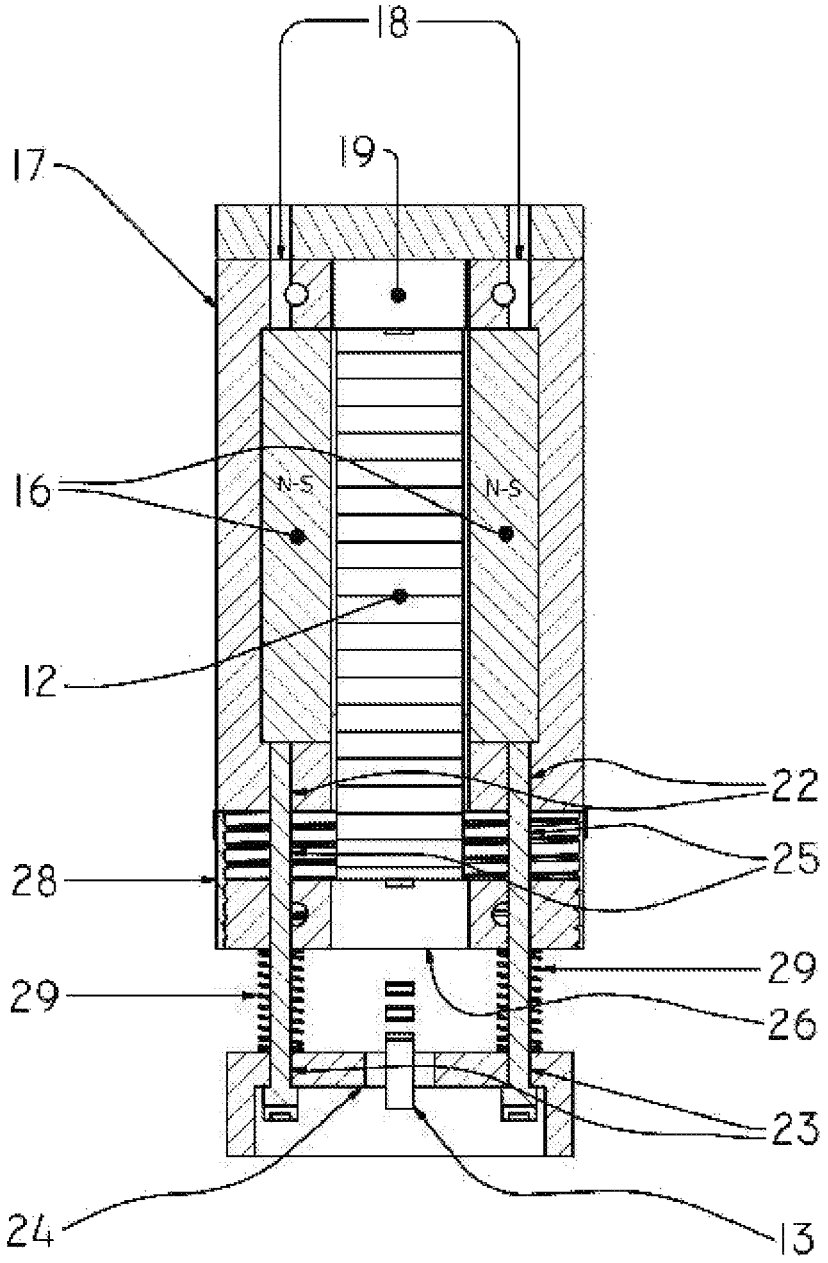
FIG. 1 is a front section view of a tunable ribbon microphone.

A tunable ribbon microphone (FIG. 1) is comprised of a magnetic field structure 10 (FIG. 2), adjustable ribbon holder structure 11 (FIG. 3), and a ribbon 12 (FIG. 1). Along with a wiring system 13 (FIG. 4), signal adjustment components and a protection shield.

Figure 2:
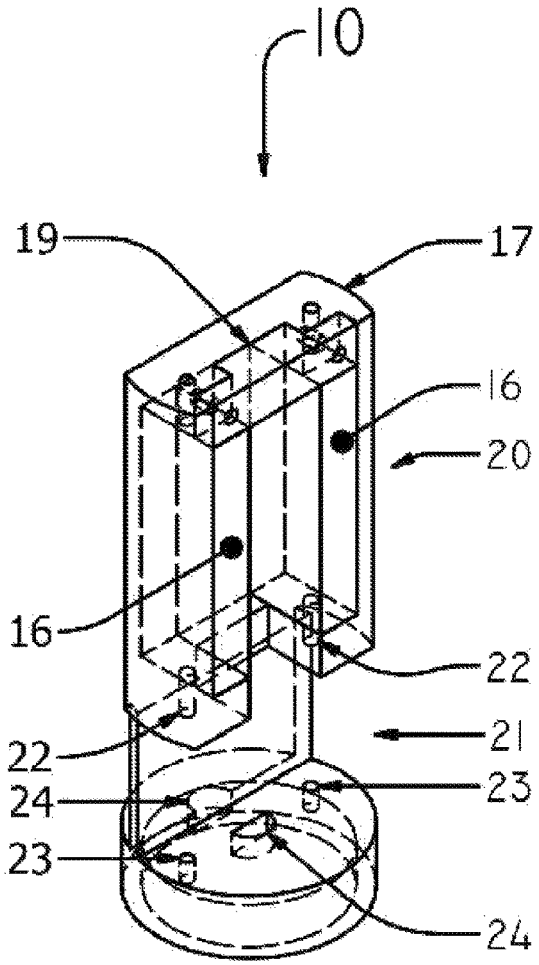
FIG. 2 is a perspective view of a magnetic field structure.

Referring to FIG. 2 the magnetic field structure 10 provides the required magnetic field for the ribbon 12 to generate sound signals. The magnetic field structure 10 includes magnets 16 and the main body 17 which also serve as a support for the elements of the microphone. There is at least one pair of magnets 16 in parallel and placed on opposite poles to the main body 17 with an air gap in between. The magnets 16 are attached to the main body 17 by any suitable method such as welding or gluing.

The main body 17 is made of a solid material and includes a fixed ribbon holder 19, magnet placement area 20, adjustable ribbon holder placement area 21; middle body threaded holes 22, lower body holes 23, and wiring holes 24. The magnetic field structure's shape and components could change in order to maximizing the magnetic field in the ribbon 12 area. Rather than magnetic field structure 10 a tunable ribbon microphone can use different mechanisms to capture sound signals such as using movement capture sensors to capture the ribbon 12 or diaphragm movements. In this case the ribbon 12 or diaphragm may not be required to be conductive, and the size of the tunable ribbon microphone becomes much smaller due to the elimination of magnets 16 in magnetic field structure 10. The overall shape of tunable ribbon microphone can vary, and the attached drawings are examples to help better understanding of the invention.

The adjustable ribbon holder structure 11 (FIG. 3) alters the tension of the ribbon 12 by changing the distance of the ribbon holders 19 and 26, folding or rolling ribbon 12 on one side or both sides. The adjustable ribbon holder structure 11 can be motorize, in this case we can control the tension of the ribbon 12 digitally and more precisely.

The main purpose of the adjustable ribbon holder structure 11 is to control the tension of the ribbon 12, and the design of the structure is not restricted to the following examples.

Figure 3:
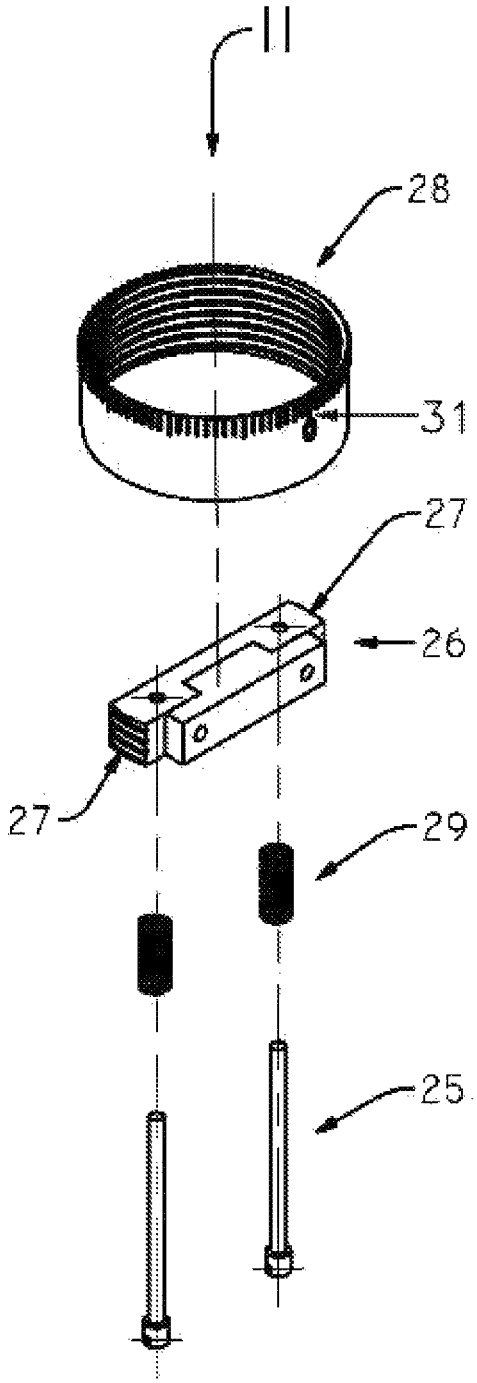
FIG. 3 is an exploded view of an adjustable ribbon holder structure.
Figure 5:
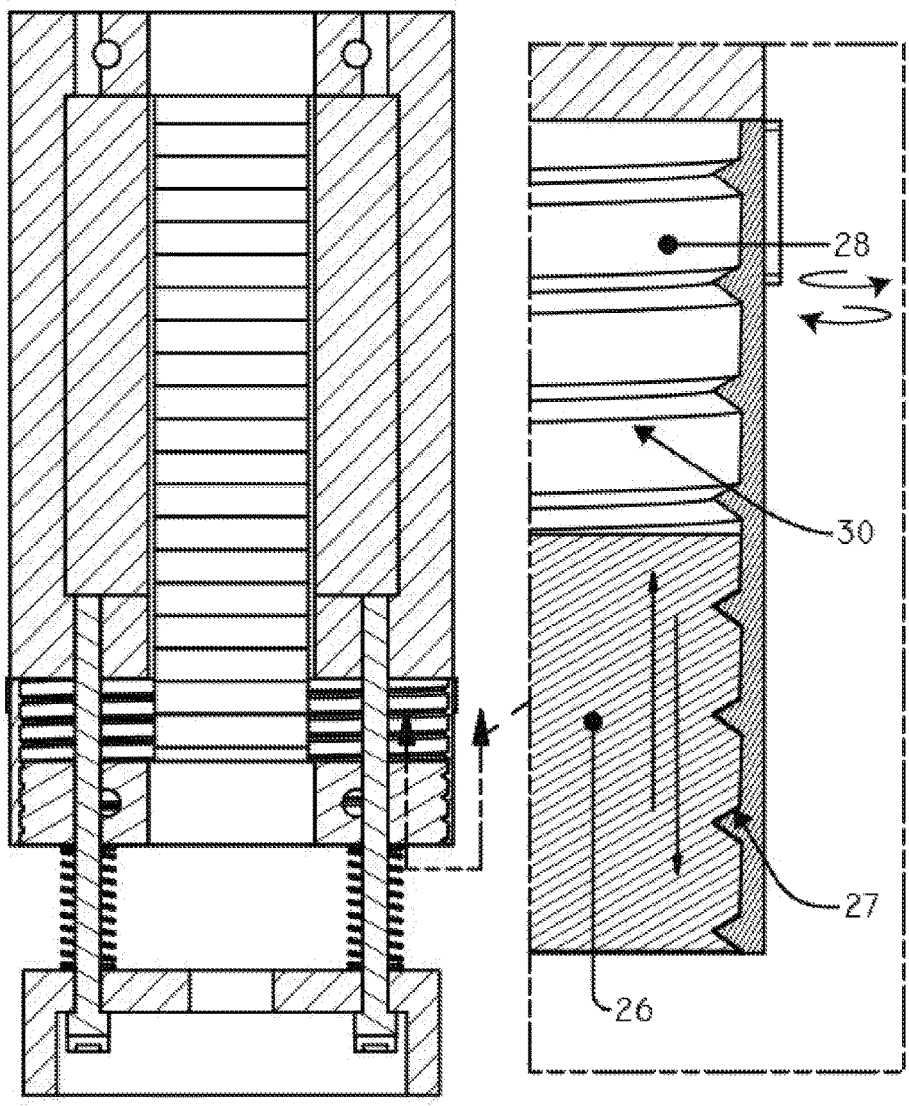
FIG. 5 is a detailed view of an adjustable ribbon holder structure.

The adjustable ribbon holder structure 11 consists of a pair of ribbon holder supports 25, an adjustable ribbon holder 26 with round threaded sides and a ribbon tension control 28. The ribbon holder supports 25 are inserted through the lower body holes 23 in the main body 17 and tightened to the middle body threaded holes 22. Preferably a pair of rubber compression springs 29 are inserted in the ribbon holder supports 25 and force adjustable ribbon holder 26 to return to its default position. The compression springs 29 also stop the adjustable ribbon holder 26 from rattling and smoothing out the movement of ribbon tension control 28. Referring to FIGS. 1 and 2 adjustable ribbon holder 26 is placed in the adjustable ribbon holder placement area 21 by the ribbon holder supports 25. Ribbon holder supports 25 are fastened to the middle body threaded holes 22 of the main body 17. Referring to FIGS. 3 and 5 the ribbon tension control 28 is a ring with threads 30 inside. By engaging the ribbon tension control 28 to the adjustable ribbon holder's threads 27, we can control the movement of the adjustable ribbon holder 26. By turning the ribbon tension control 28, the rotating motion translates to linear motion and moves the adjustable ribbon holder 26 in the axis of ribbon holder supports 25. The preciseness of movement of the adjustable ribbon holder 26 depends on the size of the threads 30 inside the ribbon tension control 28 and the adjustable ribbon holder's threads 27.

Figure 7:
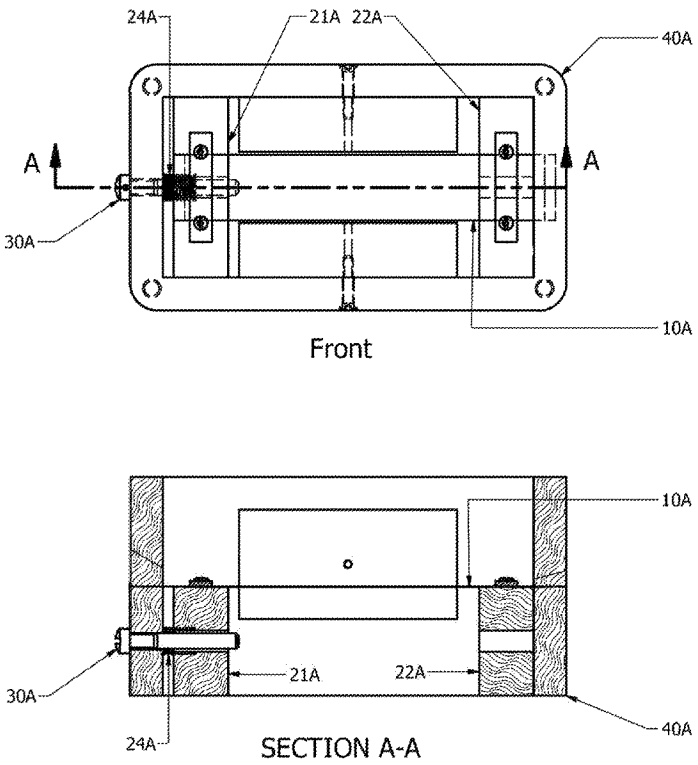
FIG. 7 is a front and section view of an alternative design of a tunable ribbon microphone.

Referring to FIG. 7 as another example of adjustment ribbon holder structure, a fine adjustment screw 30A passes through the body 40A from the outside and is connected to the sliding ribbon holder 21A. A compression spring 24A is placed between the body 40A and the sliding ribbon holder 21A. The compression spring 24A forces the sliding ribbon holder 21A toward the center of the microphone and keeps the sliding ribbon holder 21A steady. Rotation of the fine adjustment screw 30A with help of the compression spring 24A, moves the sliding ribbon holder 21A toward the center of the microphone or in reverse. The movements of the sliding ribbon holder 21A alter the distance between two ribbon holders 21A, 22A and change the tension of the ribbon 10A.

Yet another example of adjustment ribbon holder structure is to use two partially threaded screws rigidly tightened to the body. The sliding ribbon holder and two compression springs are located between the partially threaded screws and the main body. The compression springs are between the sliding ribbon holder and the head of the partially threaded screws. The compression springs keep the sliding ribbon holder in place and control the movement of it. With the help of a fine threaded hole or a fine threaded bushing within the body and a fine adjustment screw we can control the position of the sliding ribbon holder. By turning the fine adjustment screw in one direction, it moves more into the body and pushes the sliding ribbon holder to the center of the microphone. Therefore, turning the fine adjustment screw in reverse, it moves the fine adjustment screw out of the body so the spring forces the sliding ribbon holder back to the sides.

Adjustable ribbon holder structure 11 may have more than one adjustable ribbon holder 26 and ribbon tension control 28 and may not have any fixed ribbon holder 19. The parts can be positioned differently depending on the number of ribbons 12 and ribbon holders 26 and/or 19.

Referring to FIG. 1 the ribbon 12 is placed in the air gap between the magnets 16 precisely by adjustable ribbon holder structure 11 and secured by ribbon fixtures. The ribbon 12 made of one or many layers of thin and light conductive or elastic or conductive and elastic materials such as patent No.: "U.S. Pat. No. 8,218,795 B2" or "U.S. Pat. No. 8,331,588 B2" or any new upcoming materials with the desired property inherent. The ribbon 12 can corrugate and/or perforate partially and/or pinpoint to optimize sensitivity to achieve a wider frequency range. The ribbon 12 preferably is 2.5 microns thick, 0.18" wide and 1.5" long in the default tension. The ribbon 12 should have moderate elasticity inherent and ability to stretch and contract repeatedly. The shape and sizes of the ribbon 12 varies depending on the functionality. Referring to patent No.: "U.S. Pat. No. 2,699,474" movements of sound waves in the air vibrate the ribbon 12 and the movement of the ribbon 12 is converted to the audio signals.

Referring to FIGS. 4*a* and 4*b*, the preferred wiring system 13 includes wires routing from each side of the ribbon 12 to the wiring holes 24 in the main body 17 and the wires connected to the signal adjustment components. Insulated ribbon wires 13 which are attached to the main body 17, prevent any probable undesired sounds made by the movements of the wires. The wires are placed under the ribbon 12 and rigidly fixed to the ribbon holders 19 and 26. The ribbon 12 and wiring system 13 have to be insulated from all the other parts and connected to signal adjustment components. Referring to FIG. 4*b* as an example of the wiring system 13, the wire attached to the adjustable ribbon holder 26 is preferably folded 32 to achieve better coordination with the adjustable ribbon holder 26 actions.

Usually, the signal produced by the ribbon 12 is low current. So the signal adjustment components raise and balance the current by use of a step up transformer by factor of 1:20 or 1:25. The signal adjustment components can vary depending on desired signal output. The signal adjustment components can be one or two transformers with different ratio in conjunction with a tube or transistor buffer amplifier. The signal adjustment components are preferably placed in lower body 33 of the tunable ribbon microphone to minimize magnetic interferences and are fed by the ribbon's 12 signals. The final signal is routed to the microphone output connector.

Figure 6:
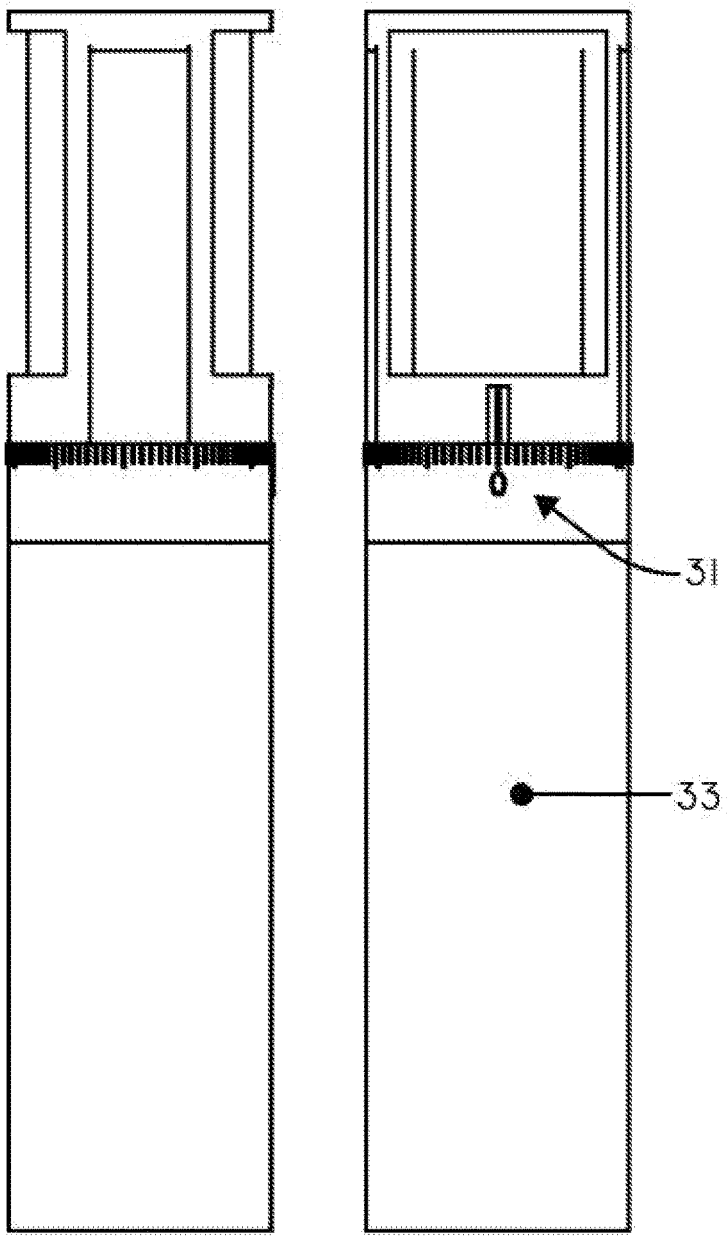
FIG. 6 is a front and side view of a tunable ribbon microphone.

Referring to FIGS. 5 and 6 by turning the ribbon tension control 28 the adjustable ribbon holder 26 moves closer to the center of the microphone. The distance between the adjustable ribbon holder 26 and the fixed ribbon holder 19 decrease and the ribbon 12 loosens up. Apparently by turning the ribbon tension control 28 in the opposite direction, the adjustable ribbon holder 26 starts to move in reverse and the ribbon 12 becomes tense. Different tension of the ribbon 12 causes distinctive responses to the sound source, and it gives the ability to shape the sound before it is converted into a signal that it is not possible in conventional microphones. The amount of tension can be measured by the measurement bar 31 imprinted on ribbon tension control 28. So the tension of the ribbon 12 can to factory default setting at any time.

The ribbon tension control 28 can be equipped with a locking system to keep the ribbon tension control 28 from changing when it is unnecessary.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A tunable ribbon microphone for building a ribbon microphone with the ability to adjust the tension of the ribbon by a user depending on a sound source and desired sound characteristic, comprising:

means for providing a required magnetic field and a main body for other components;

means for keeping all the elements in place;

means for generating a magnetic field, rigidly attached to said means for providing a required magnetic field and a main body for other components;

means for rigidly keeping the ribbon in place from one side, rigidly constructed to said means for providing a required magnetic field and a main body for other components;

actuating means for providing a mechanism to precisely control the tension of the ribbon, rigidly assembled to said means for providing a required magnetic field and a main body for other components;

referencing means for precisely controlling and measuring the movement of an adjustable ribbon holder and said actuating means, providing a specific referencing scale in regards to the position of said adjustable ribbon holder and the tension of the ribbon to precisely adjust or recall a specific setting of said adjustable ribbon holder;

means for keeping the ribbon in place, turnably connected to said referencing means for precisely controlling and measuring the movement of said adjustable ribbon holder, and slidably assembled to said actuating means for providing a mechanism to precisely control the tension of the ribbon;

means for restricting the axial movement of said adjustable ribbon holder, rigidly connected to said actuating means for providing a mechanism to precisely control the tension of the ribbon, and rigidly connected to said means for providing a required magnetic field and a main body for other components;

means for routing the ribbon signals to the signal adjustment components, tightly connected to said means for keeping the ribbon in place, and tightly connected to said means for keeping the ribbon in place from one side; and means for capturing the movements of the air and converting them to electrical signals, tightly connected to said means for routing the ribbon signals to the signal adjustment components, tightly placed to said means for keeping the ribbon in place, and tightly placed to said means for rigidly keeping the ribbon in place from one side.

2. The tunable ribbon microphone in accordance with claim 1, wherein said means for generating a magnetic field is comprised of magnets.

3. The tunable ribbon microphone in accordance with claim 1, wherein said means for keeping the ribbon in place from one side is comprised of a fixed or sliding ribbon holder.

4. The tunable ribbon microphone in accordance with claim 1, wherein said actuating means for providing a mechanism to precisely control the tension of the ribbon comprises a manual or motorized or manual and motorized actuating mechanism.

5. The tunable ribbon microphone in accordance with claim 4, wherein said actuating mechanism can be controlled digitally.

6. The tunable ribbon microphone in accordance with claim 1, wherein said actuating means for precisely controlling and measuring the movement of said adjustable ribbon holder is comprised of a threaded actuating mechanism on the inside and referencing measurement bar on the outside of said tunable ribbon microphone.

7. The tunable ribbon microphone in accordance with claim 1, wherein said referencing means for precisely controlling and measuring the movement of said adjustable ribbon holder provide the ability to adjust and recall factory or specific settings by referencing the movements of said actuating mechanism and the position of said adjustable ribbon holder and the fundamental frequency resonance of said ribbon.

8. The tunable ribbon microphone in accordance with claim 7, wherein said referencing means for precisely controlling and measuring the movement of said adjustable ribbon holder further comprise a locking system to protect the adjustment of said referencing means from accidental changes.

9. The tunable ribbon microphone in accordance with claim 1, wherein said means for restricting the axial movement of adjustable ribbon holder is comprised of a sliding mechanism for restricting the axial movement of said adjustable ribbon holder.

10. The tunable ribbon microphone in accordance with claim 1, wherein said means for routing the ribbon signals to the signal adjustment components is comprised of conductors.

11. The tunable ribbon microphone in accordance with claim 1, wherein said means for capturing the movements of the air and converting them to electrical signals is comprised of an elastic ribbon.

12. A tunable ribbon microphone for building a ribbon microphone with the ability to adjust the tension of the ribbon by a user depending on a sound source and desired sound characteristic, comprising:

a magnetic field structure, for providing a required magnetic field and a main body for other components;

a strong main body, for keeping all the elements in place;

magnets, for generating a magnetic field, rigidly attached to said magnetic field structure;

a fixed ribbon holder, for keeping the ribbon in place from one side, rigidly constructed to said magnetic field structure;

an adjustable ribbon holder structure, providing a mechanism to precisely control the tension of the ribbon, rigidly assembled to said magnetic field structure;

an adjustable ribbon holder with an actuating mechanism and threads on each side, for keeping the ribbon in place, turnably connected to said ribbon tension control, and slidably assembled to said adjustable ribbon holder structure;

a ribbon tension control with a threaded actuating mechanism on the inside and referencing measurement bar on the outside, providing a specific referencing scale in regards to the position of said adjustable ribbon holder and the tension of the ribbon to precisely adjust or recall a specific setting of said adjustable ribbon holder;

an adjustable ribbon holder slider, for restricting the axial movement of adjustable ribbon holder, rigidly connected to said adjustable ribbon holder structure, and rigidly connected to said magnetic field structure;

a conductive wiring system, for routing the ribbon signals to the signal adjustment components, tightly connected to said adjustable ribbon holder, and tightly connected to said fixed ribbon holder; and an elastic ribbon, for capturing the movements of the air and converting to electrical signals, tightly connected to said wiring system, tightly placed to said adjustable ribbon holder, and tightly placed to said fixed ribbon holder.

13. The tunable ribbon microphone as recited in claim 12, further comprising:

springs, for preventing unnecessary movements of said adjustable ribbon holder, freely connected to said adjustable ribbon holder structure, freely assembled to said adjustable ribbon holder, and freely assembled to said adjustable ribbon holder slider.

14. The tunable ribbon microphone as recited in claim 12, wherein said adjustable ribbon holder comprises more than one adjustable ribbon holder.

15. The tunable ribbon microphone as recited in claim 12, wherein said conductive ribbon comprises more than one conductive ribbon.

16. The tunable ribbon microphone as recited in claim 12, wherein said adjustable ribbon holder is sliding.

17. The tunable ribbon microphone as recited in claim 12, wherein said wiring system is a folded or sliding conductor.

18. The tunable ribbon microphone as recited in claim 12, wherein said ribbon is single layer conductive or multi layered composite or polymer.

19. A tunable ribbon microphone for building a ribbon microphone with the ability to adjust the tension of the ribbon by a user depending on a sound source and desired sound characteristic, comprising:

a magnetic field structure, for providing a required magnetic field and a main body for other components;

a strong main body, for keeping all the elements in place;

neodymium magnets, for generating said magnetic field, rigidly attached to said magnetic field structure;

a fixed ribbon holder, for keeping the ribbon in place from one side, rigidly constructed to said magnetic field structure;

an adjustable ribbon holder structure, for providing a mechanism to precisely control the tension of the ribbon, rigidly assembled to said magnetic field structure;

a sliding adjustable ribbon holder with an actuating mechanism and threads on the sides, for keeping the ribbon in place, turnably engaged to said ribbon tension control, and slidably assembled to said adjustable ribbon holder structure;

a ribbon tension control with actuating mechanism and threads on the inside and referencing measurement bar on the outside, providing a specific referencing scale in regards to the position of said adjustable ribbon holder and the tension of the ribbon to precisely adjust or recall a specific setting of said adjustable ribbon holder;

springs, for preventing unnecessary movements of adjustable ribbon holder, freely assembled to said adjustable ribbon holder, and freely connected to said adjustable ribbon holder structure;

an adjustable ribbon holder slider, for restricting the axial movement of said adjustable ribbon holder, freely assembled to said springs, rigidly connected to said adjustable ribbon holder structure, and rigidly connected to said magnetic field structure;

a folded conductive wiring system, for routing the ribbon signals to the signal adjustment components, tightly connected to said adjustable ribbon holder, and tightly connected to said fixed ribbon holder; and an elastic, conductive ribbon, for capturing the movements of the air and converting them to electrical signals, tightly connected to said wiring system, tightly placed to said adjustable ribbon holder, and tightly placed to said fixed ribbon holder.

* * * * *